US012529302B2

(12) United States Patent
Roadarmel et al.

(10) Patent No.: US 12,529,302 B2
(45) Date of Patent: Jan. 20, 2026

(54) SYSTEM AND METHOD FOR DEPLOYING SENSING CABLE INTO A WELL

(71) Applicant: Halliburton Energy Services, Inc., Houston, TX (US)

(72) Inventors: William Roadarmel, Bakersfield, CA (US); Cole Aaron Grandjean, Santa Fe, TX (US); Justin Michael Yip, Houston, TX (US); Mikko K. Jaaskelainen, Houston, TX (US); Aaron Williams, Bakersfield, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 49 days.

(21) Appl. No.: 18/347,514

(22) Filed: Jul. 5, 2023

(65) Prior Publication Data

US 2025/0012182 A1 Jan. 9, 2025

(51) Int. Cl.
*E21B 47/00* (2012.01)
*E21B 19/084* (2006.01)

(52) U.S. Cl.
CPC ..... *E21B 47/00* (2013.01); *E21B 19/084* (2013.01)

(58) Field of Classification Search
CPC ..... E21B 23/08
See application file for complete search history.

(56) References Cited

U.S. PATENT DOCUMENTS

| | | | | |
|---|---|---|---|---|
| 6,640,900 | B2 | 11/2003 | Smith | |
| 6,766,703 | B1 * | 7/2004 | Kluth | E21B 23/08 73/152.28 |
| 10,738,577 | B2 | 8/2020 | Varkey et al. | |
| 11,365,958 | B2 * | 6/2022 | Bouldin | E21B 47/07 |
| 2018/0374607 | A1 * | 12/2018 | Hernandez Marti | E21B 17/003 |
| 2020/0072995 | A1 | 3/2020 | Milne et al. | |
| 2022/0290521 | A1 * | 9/2022 | Skauen | E21B 33/0385 |

* cited by examiner

*Primary Examiner* — William D Hutton, Jr.
*Assistant Examiner* — Avi T Skaist

(57) ABSTRACT

Disclosed are systems and methods of monitoring a well that includes a production tubing installed in the well and supported by a wellhead with an annulus between the production tubing and a well casing. While the production tubing remains installed in the well, a valve of the wellhead is opened to provide access to the annulus through a side port of the wellhead. A cable guide is inserted through the valve, the cable guide including a conduit for inserting a sensing cable through the cable guide. A sensing cable is inserted through the conduit of the cable guide and into the annulus through the side port. One or more parameters of the well are measured using the sensing cable and signals representative of the parameters are transmitted along the sensing cable. The signals from the sensing cable are obtained and processed using a computing system to determine the parameters.

15 Claims, 13 Drawing Sheets

SYSTEM AND METHOD FOR DEPLOYING SENSING CABLE INTO A WELL

BACKGROUND

Well monitoring is a critical component of oil and gas production, especially for vertical wells, which frequently necessitate constant monitoring to comply with regulatory requirements and operational needs.

There are various monitoring techniques that can be utilized to ensure desirable performance and safety, including time-lapse seismic profiling, vertical seismic profiling, distributed acoustic sensing, and distributed temperature sensing.

Certain monitoring techniques require deployment of a sensing cable into a vertical well, but this process has been time-consuming and expensive. In many instances, deploying optical fiber necessitates well intervention and workovers resulting in significant expenses and potential production loss. This is largely due to the need to remove the production tree and extract the production tubing from the wellhead, which interrupts regular production and introduces additional labor and equipment costs.

BRIEF DESCRIPTION OF THE DRAWINGS

Embodiments of the system and method for deploying sensing cable into well are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present application discloses systems and methods for monitoring a well efficiently to lessen disruption to production and cut down on cost. An example system features a wellbore with a production tubing installed and supported in a wellhead at the surface and a casing surrounding the production tubing. The nested nature of the production tubing within the wellbore creates an annulus between the production tubing and the wellhead at the surface and the casing in the well. The wellhead supports the production tubing and the casing and is equipped with a side port that provides access to the annulus, a gate valve for opening and closing access to the side port, and a valve collar connected to the gate valve for connecting external devices.

The present application involves deployment of a sensing cable (sensing wire) into the annulus via the side port of the wellhead. The deployment process avoids having to pull the production tubing, thus overcoming significant challenges in well monitoring relating to time and cost.

The patent application further discloses a sensing cable deployment system, which includes an alignment collar for connecting the system to the gate valve of the wellhead, a cable guide for inserting through the gate valve and the side port, a cable guide positioner operable to movably position the cable guide relative to the wellhead, a cable injection system for injecting a sensing cable through the cable guide and into the annulus through the side port.

The patent application further discloses a method of deploying a sensing cable using the sensing cable deployment system. First, the sensing cable deployment system is connected to wellhead. The alignment collar is coupled to the valve collar while the gate valve remains closed. Then, the gate valve is opened to provide access to the annulus. One or more pressure sensors may be used to ensure there is no release of hydrocarbons or pressure leaks when opening the gate valve.

Subsequently, the cable guide positioner pushes the cable guide, along the pipe connected to the alignment collar, into the gate valve and into the annulus through the side port. One or more sensors are used to confirm that the cable guide is positioned at a predetermined position. When it is confirmed that the cable guide is positioned at the predetermined position, the cable injection system operates to deploy a sensing cable into the annulus of the well through a cable conduit (passage) formed through the cable guide.

Once the sensing cable is deployed inside the annulus, signals from the sensing cable are obtained and processed using a computing system for monitoring and analysis purposes. Based on the analysis, one or more operational parameters of the well can be adjusted. When the analysis indicates a safety concern, production of the well can be stopped until the concern is addressed and signals from the sensing cable indicates there is no longer a safety concern.

Figure 1:
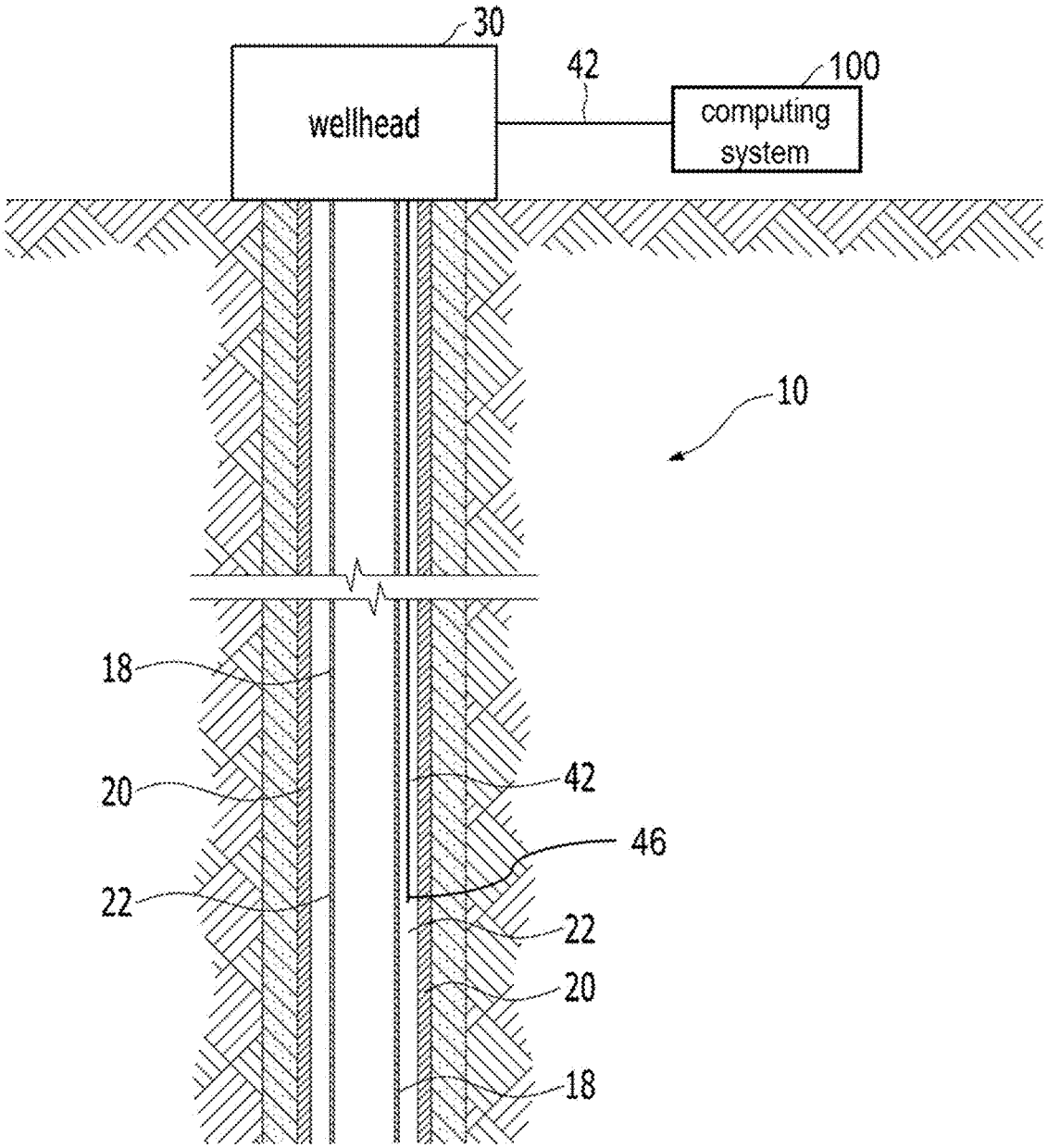
FIG. 1 is a schematic elevation view of a well and production system.

Referring now to the figures, FIG. 1 show a schematic view of a well and production system. The well includes a wellbore 10 underground and the production system includes a wellhead 30 at the surface. The well includes a production tubing 18 positioned in the wellbore 10. Although not shown in specific detail, one of ordinary skill in the art appreciates that the production tubing may be landed in the wellhead using a production tubing hanger (not shown). A casing 20 is surrounding the production tubing 18. The well includes an internal space or annulus 22 between the production tubing 18 and the casing 20. The internal space may be an annular space separating a round tubing and a round casing. In embodiments, a well and its components (wellbore, tubing, casing) may have a different structure from the embodiment depicted in FIG. 1.

For monitoring of the well, at least one sensing cable 42 is inserted into the annulus 22 via the wellhead 30. At least one computing system 100 obtains signals from the sensing cable 42. In embodiments, the computing system 100 includes one or more processors and data storages for processing signals from the sensing cable 42. In embodiments, the sensing cable 42 may include one or more sensors 46 at its end.

Figure 2:
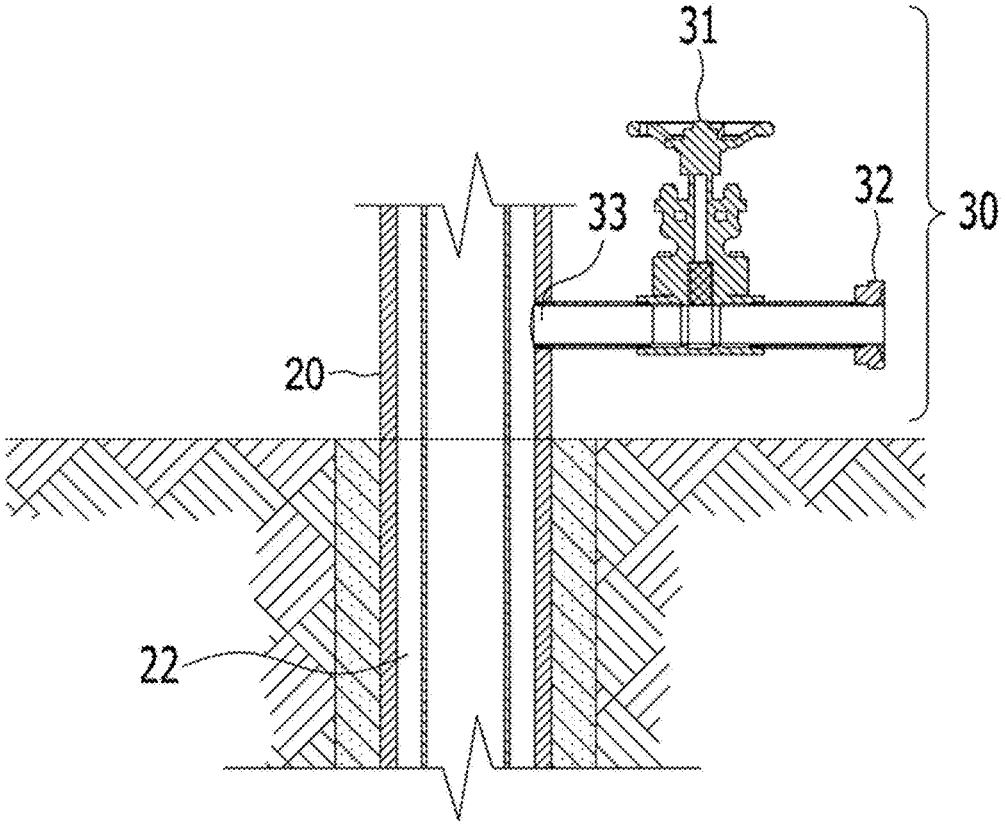
FIG. 2 illustrates a wellhead of the production system of FIG. 1.

FIG. 2 shows a wellhead of the well of FIG. 1. The wellhead 30 is used to land and support the production tubing 18 and the casing 20 in the well. The wellhead 30 includes a side port 33 that allows access to the annulus 22. The wellhead 30 further includes a gate valve 31 for controlling fluid flow through the side port 33 and a valve collar 32 for connection with an external device. In embodiments, a wellhead and its components may have a different structure or additional component(s) from the example depicted in FIG. 2. For example, a gate valve may be attached directly to the wellhead without any spacer pipe interposed and be operable as a side port by itself, and a wellhead may have an additional production fluid flow path with additional valves that are not shown in FIG. 2.

Figure 3:
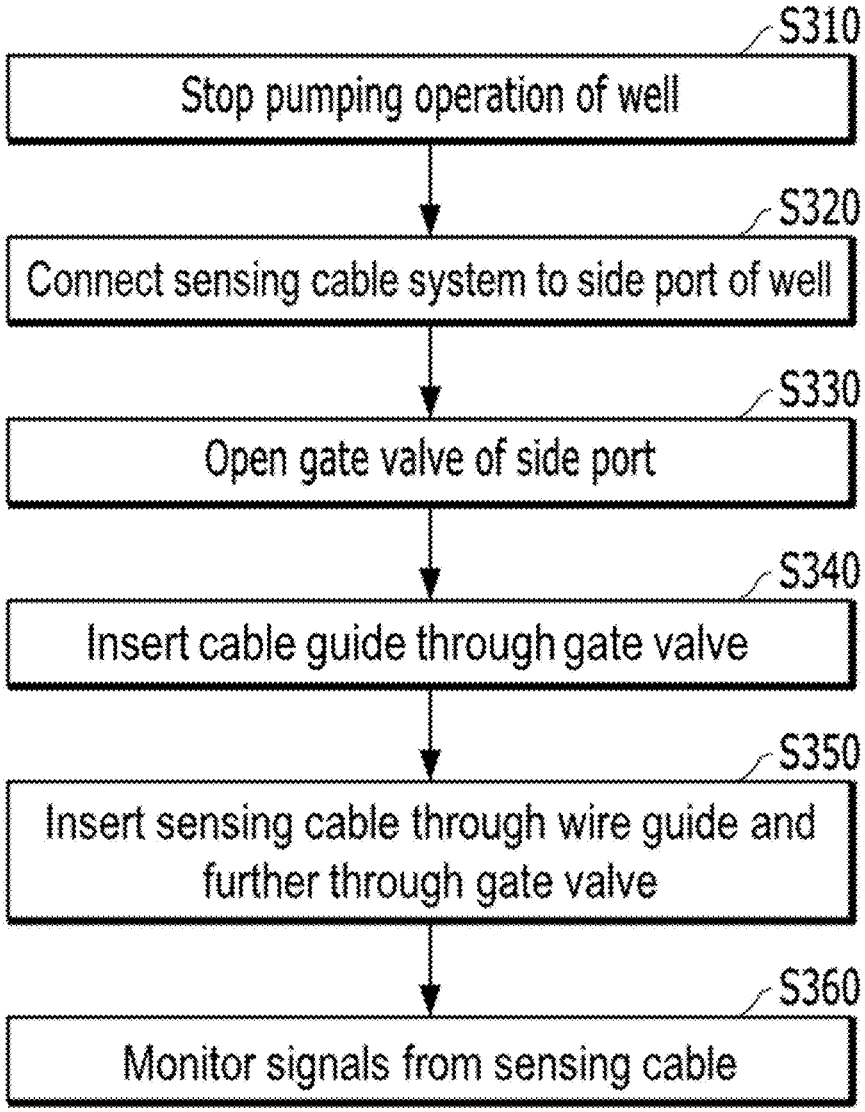
FIG. 3 is a flow chart of an example method for monitoring the well of FIG. 1.

FIG. 3 is a flow chart of an example method for deploying a sensing cable into the well of FIG. 1 and monitoring the well. The method includes: stopping a pumping operation of a well (S310), connecting a sensing cable deployment system to a side port of the well (S320), opening a gate valve of the side port (S330), inserting a cable guide through the gate valve (S340), inserting a sensing cable through the cable guide and further through the gate valve (S350), monitoring signals from the sensing cable deployed into the well through the gate valve and the side port (S360). In embodiments, a method for deploying a sensing cable into a well and monitoring the well using the sensing cable may include one or more additional processes not shown in FIG. 3. For example, after taking planned measurements the sensing cable is retrieved from the annulus 22. The process shown in FIG. 3 will be described in more detail later referencing to other figures including FIGS. 4-6.

Figure 4:
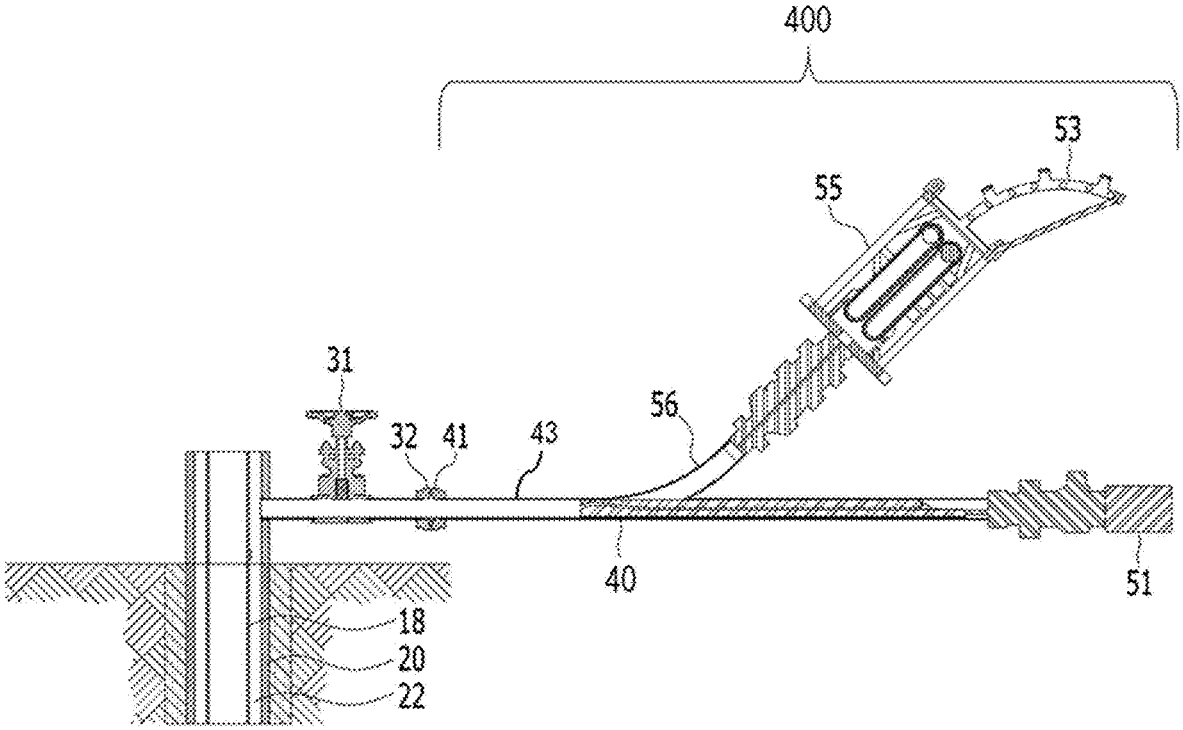
FIG. 4 illustrates a sensing cable deployment system connected to the wellhead of FIG. 2.

FIG. 4 shows a sensing cable deployment system 400 connected to the wellhead 30 of FIG. 2. The sensing cable deployment system includes an alignment collar 41, or flange, for connecting to the valve collar 32, or flange, of the wellhead 30, a guide pipe 43 extending from the alignment collar 41, a cable guide 40 moveably located in the guide pipe, a cable guide positioner 51, an injector pipe 56 connected to the guide pipe 43, a cable injector head 55 connected to the injector pipe 56, and a gooseneck guide 53. In embodiments, a sensing cable deployment system may not include one or more components shown in FIG. 4 and may include one or more additional components not shown in FIG. 4.

In embodiments, at S310, at least one operation of the well, such as production, is stopped prior to connecting the sensing cable deployment system 400 to the wellhead 30. In other embodiments, a sensing cable deployment system may be connected without an interruption or a significant modification of the operation of the well.

In embodiments, at S320, using the alignment collar 41, the sensing cable deployment system 400 is connected to the wellhead 30 by connecting the valve collar 32 with the alignment collar 41 while maintaining all barriers to contain production (hydrocarbon) from the well. For example, the gate valve 31 is closed when the sensing cable deployment system is initially connected.

In embodiments, subsequently at S330, the gate valve 31 is opened to provide access to the annulus 22. In embodiments, a pressure sensor (not shown) is used to measure a pressure in the annulus to ensure there is no release of hydrocarbons or pressure leak when opening the gate valve 31.

Figure 5:
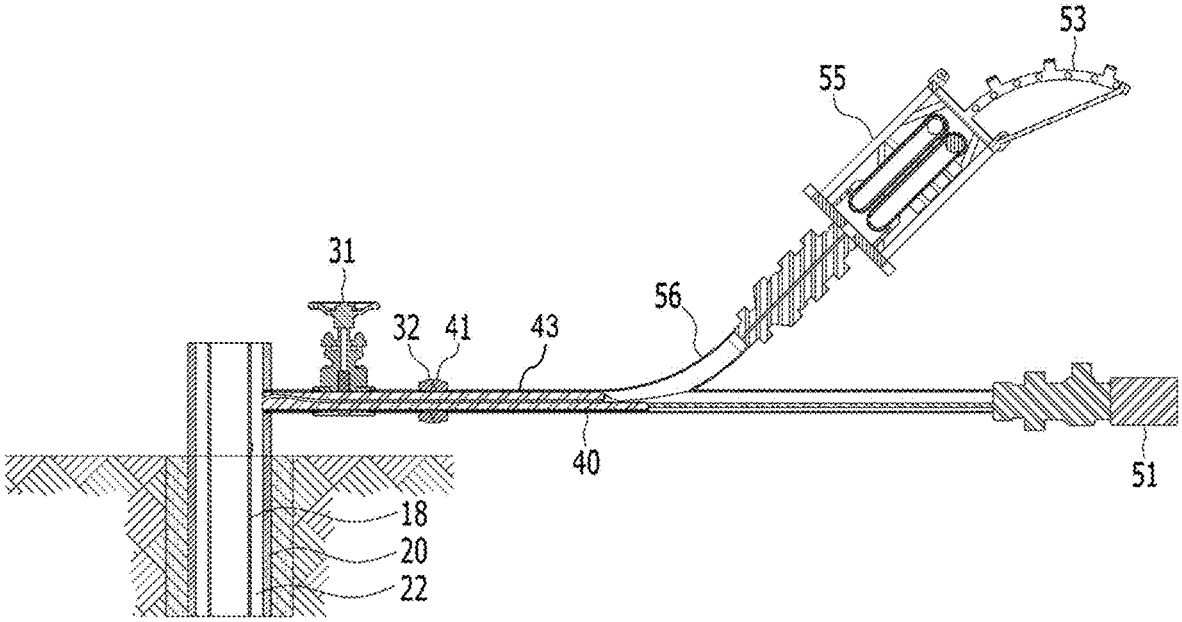
FIG. 5 illustrates the sensing cable deployment system of FIG. 4 when a cable guide is inserted through a side port of the well of FIG. 1.

In embodiments, subsequently at S340 as shown in FIG. 5, the cable guide positioner 51 operates to push the cable guide 40 such that the cable guide 40 is inserted through the gate valve 31 and further through the side port 33. In embodiments, it is possible that the cable guide 40 may not be fully inserted through the side port 33 or even through the gate valve 31.

The cable guide positioner 51 is equipped with one or more sensors and controllers that enable precise control over the positioning of the cable guide. In embodiments, these sensors, such as proximity sensors or force sensors, provide real-time feedback on the position and movement of the cable guide. The controllers utilize this information to make adjustments and ensure that the cable guide is at a selected position relative to the annulus 22. The cable guide positioner 51 is equipped with one or more actuators to generate power (for example, motors and hydraulic cylinders) and one more mechanism to move the cable guide using the power. In embodiments, the cable guide 40 includes at least one conduit for inserting a sensing cable therethrough. Structure and features of the cable guide 40 are described in more detail referencing to other drawings, including FIG. 7A to FIG. 7H, however, in embodiments, a cable guide may have a structure or feature different from FIG. 7A to FIG. 7H.

Figure 7A:
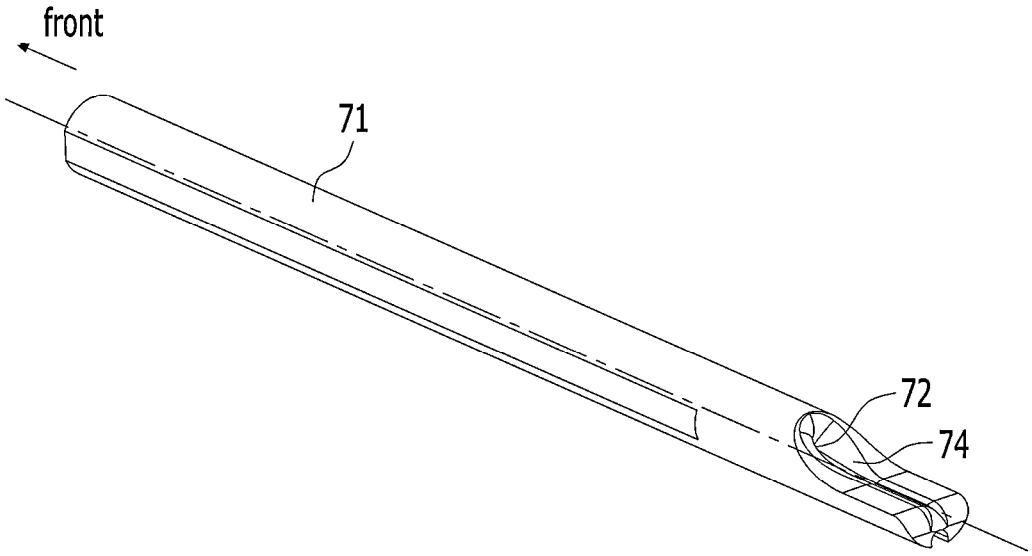
FIGS. 7A-7H illustrate an example cable guide for use in a sensing cable deployment system.
Figure 7B:
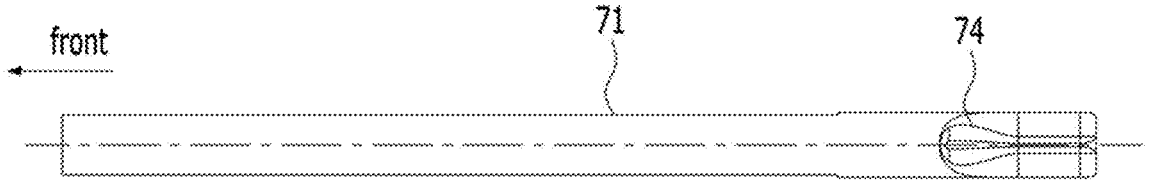
Figure 7C:
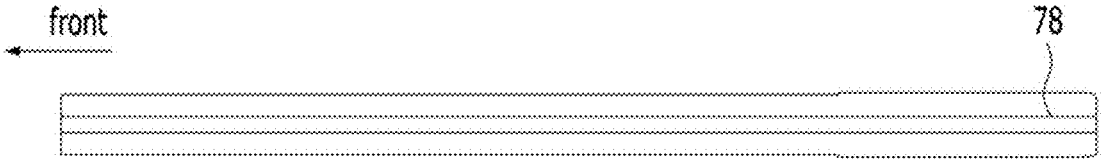
Figure 7D:
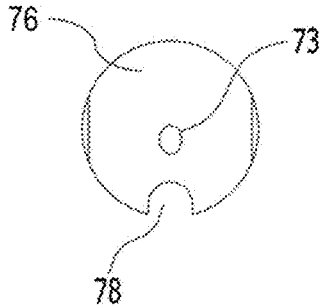
Figure 7E:
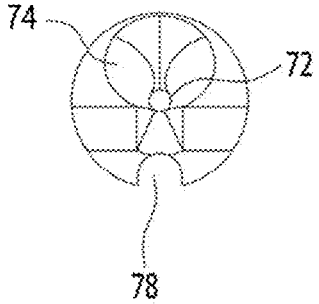
Figure 7F:
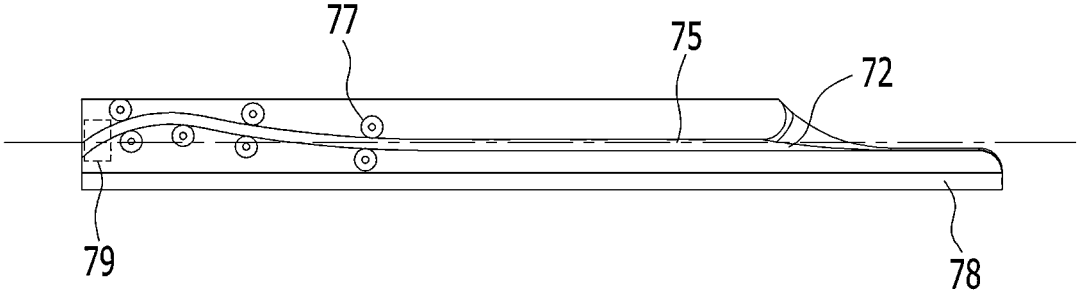

FIG. 7A is a perspective view of the cable guide 40. FIG. 7B is a top view, FIG. 7C is a bottom view, FIG. 7D is a front view, and FIG. 7E is a rear view of the wire guide 40. FIG. 7F is a side cross-sectional view, FIG. 7G is a perspective cross-sectional view, and FIG. 7H is a top cross-sectional view of the wire guide 40.

According to FIGS. 7A-7H, the cable guide 40 has a main body 71 generally extends from a front end (to face the production tubing 18) to a rear end (to face the positioner 51). A front end of the cable guide 40 is sized such that it can pass through the side port 33 when the cable guide 40 is inserted through the gate valve 31. The cable guide 40 includes a cable conduit 75 formed through the main body 71 extending from a cable inlet 72 (cable receiving hole) to a cable outlet 73 (cable releasing hole). The cable outlet 73 is formed at an end surface 76 (front end surface) of the cable guide 40 that is to face the production tubing when the cable guide is inserted. The cable conduit 75 is dimensioned to allow the sensing cable to pass through smoothly. However, the cable conduit 75 is not sized to create excess space and risk the sensing cable getting tangled inside the cable guide 40.

Figure 7G:
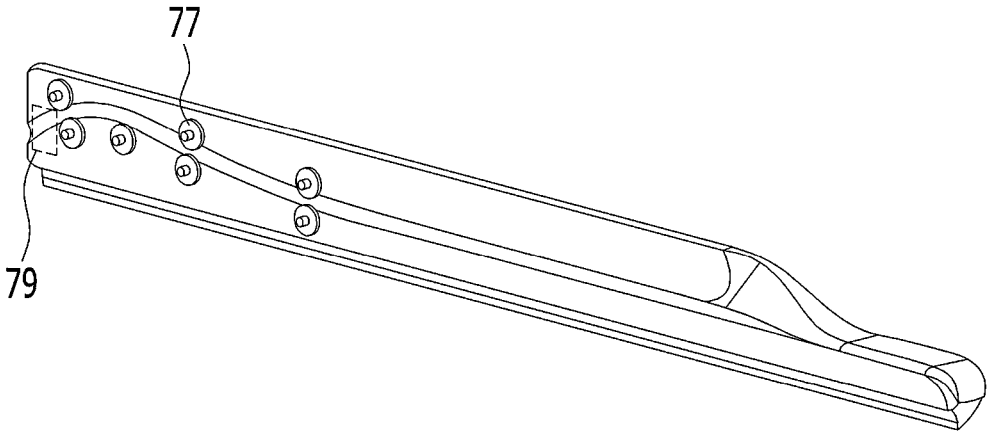
Figure 7H:
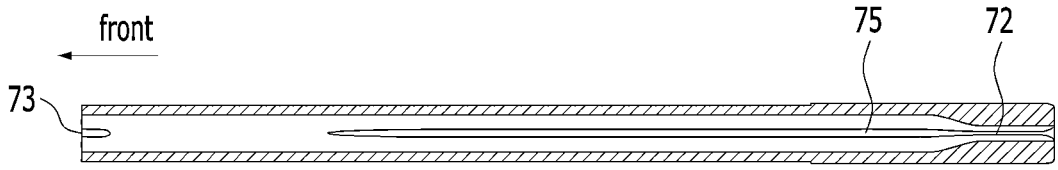

According to FIGS. 7F and 7G, the cable conduit 75 comprises an end portion 79 extending to the cable outlet 73. The end portion 79 configured to determine the insertion angle (release angle) of the sensing cable 42 into the annulus 22. The end portion 79 extends along a downward direction such that the sensing cable 42 is directed down to a deeper portion of the well when the cable is released from the cable outlet 73 rather than perpendicular to the well or upward. Inserting the sensing cable downward provides advantages of, for example, ease of navigation and reduced risk of damage. Downward direction facilitates the natural tendency of the sensing cable to follow gravity, which can make the insertion process smoother and more manageable. If the cable were inserted upward or perpendicular, it could more easily kink, twist, or get caught on the sides of the well, potentially damaging the cable and impeding its functionality.

Around the cable inlet 72, a curved surface 74 is provided. The curved surface 74 is designed to guide a sensing cable from the injector head 55 into the cable inlet 72. When the sensing cable 42 is first introduced into the cable guide 40, a starting end of the sensing cable 42 slides along this curved surface 74 and is guided into the cable inlet 72.

The cable guide 40 includes one or more one or more rollers 77 installed along the cable conduit 75. The sensing cable 42 contacts the one or more rollers 77, which rotate to relieve friction when the sensing cable 42 advances the along the cable conduit 75. In embodiments, a mechanism different from the rollers 77 may be installed along the cable conduit 75 to facilitate insertion of the sensing cable 42.

The cable guide 40 also includes a pressure relief channel 78 formed on the outside of the main body 71. The pressure relief channel 78 is separate from the cable conduit 75 and allows pressure to equalize pressure between the annulus 22 and a space outside the well and within the cable deployment system when the sensing cable 42 is being inserted through the cable guide 40.

Figure 6:
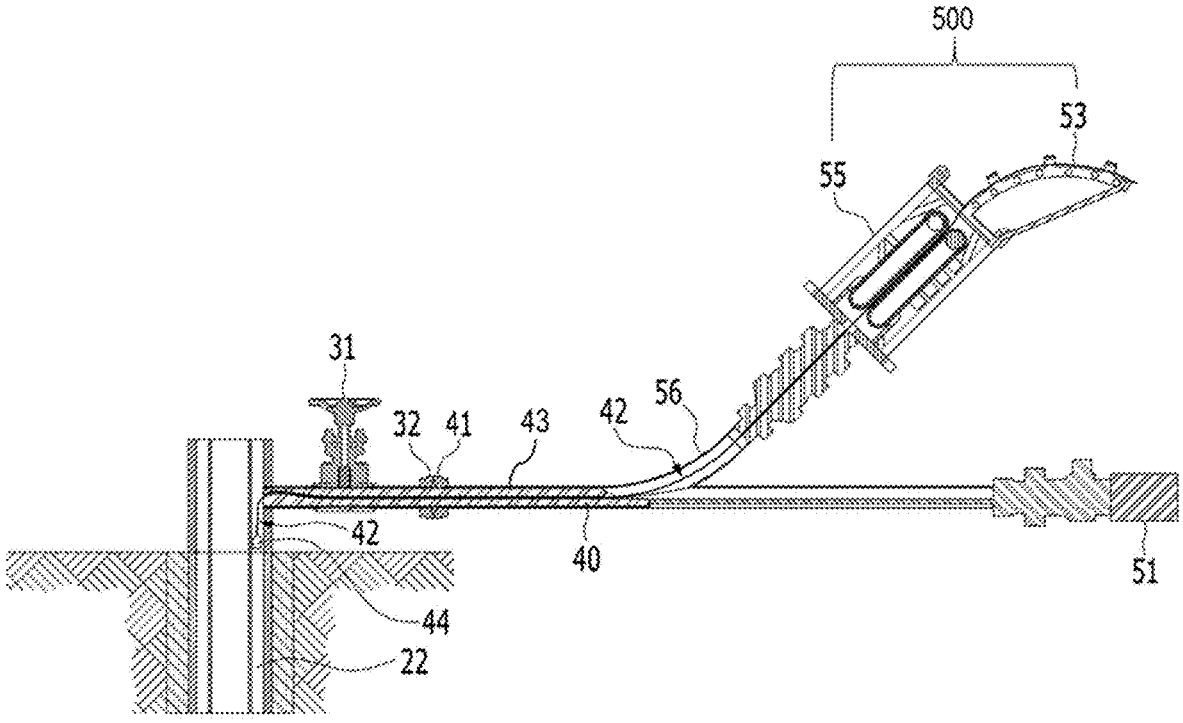
FIG. 6 illustrates the sensing cable deployment system of FIG. 4 when a sensing cable is inserted into the well of FIG. 1.

In embodiments, subsequently at S350 and as shown in FIG. 6, a cable injection system 500 operates to insert the sensing cable 42 through the cable guide 40. The cable injection system 500 features the cable injector head 55 and the gooseneck guide 53. In an example process, the sensing cable 42 is initially unwound from a spool (not illustrated in the figures), and then directed towards the gooseneck guide 53 and the injector head 55. The gooseneck guide 53 is specifically designed to guide the cable smoothly from the spool to the injector head 55, preventing potential cable tangles or mishandling. The injector head 55 is equipped with one or more mechanisms that serve to push the sensing cable into the cable guide 40. For example, the injector head 55 may include one or more rollers, one or more conveyor belts, and one or more motors. The cable injection system may also include sensors and controllers to ensure precision and accuracy in the sensing cable's movement. In embodiments, a cable inserting system may have a structure or feature different from the example discussed.

In embodiments, a fluid may be applied through the injector head 55 to enhance lubrication for movement of the cable guide 40 and for movement of the sensing cable 42. For instance, for a heavier cable assembly (sensing cable), a fluid with a higher viscosity may be pumped through the cable guide 40 to reduce friction. For lighter cable assemblies, a low viscosity fluid (or compressed gas) may be used.

The sensing cable 42 may include a flexible optical fiber. In embodiments, the sensing cable 42 can adopt a bare optical fiber design. An example bare optical fiber design features a fiber core (for example, glass or plastic filament), a cladding surrounding the fiber core and having a refractive index lower than that of the fiber core, and a coating (for example, acrylate or polyimide) surrounding the cladding.

In certain embodiments, the sensing cable 42 can utilize a Fiber-In-Metal Tube (FIMT) design. The FIMT design features one or more optical fibers enclosed within a metal tube. The metal tube is typically constructed from highly corrosion-resistant metals such as stainless steel. In embodiments, a filling gel is used to fill space surrounding optical fibers inside the metal tube, serving as a protective barrier against water ingress.

In embodiments, the sensing cable 42 can adopt a slickline design that combines electrically conductive wire(s) with addition to a FIMT design. In embodiments, the sensing cable 42 can adopt a wireline design which features wire braid sit on top of a FIMT or on top of a polymer buffered optical fiber.

In certain embodiments, this sensing cable 42 incorporates a ruggedized design with an enhanced coating to provide extra protection against harsh conditions that might be encountered within the well.

In embodiments, the sensing cable 42 functions as a sensing element within various sensing systems, including but not limited to a Distributed Temperature Sensing (DTS) system, a Distributed Acoustic Sensing (DAS) system, and a Distributed Strain Sensing (DSS) system. Changes in the surrounding environment such as temperature, acoustic waves, or strain, affect properties of optical fiber(s) in the sensing cable 42 and cause alterations of light signal transmission. The alterations are detected and analyzed to determined one or more parameters of the well. In embodiments, two or more sensing systems may in some embodiments be multiplexed on a single optical fiber.

For example, in a Distributed Temperature Sensing (DTS) system, temperature variations along the fiber cause changes in backscattered optical light so e.g. a Raman scattering based DTS system measure back scattered energy at Stokes and anti-Stokes wavelengths and the temperature can be calculated as a function of the ratios of the measured Stokes and anti-Stokes signals. These changes affect the backscattered light, allowing for temperature measurements at different points along the sensing cable 42. In a Distributed Acoustic Sensing (DAS) system, acoustic waves or vibrations cause variations of the optical path length of optical fiber(s) inside the sensing cable 42. These deformations modulate the light signal propagating through the sensing cable 42, enabling the detection and localization of acoustic events. In a Distributed Strain Sensing (DSS) system, strain or deformation applied to the sensing cable 42 alters length or stress distribution of optical fiber(s) inside the sensing cable 42. Changes of light signal transmission corresponding to alteration of the length or stress distribution can be interpreted as strain measurements along the fiber.

In embodiments, one or more point sensors 46 can be installed at one end of the sensing cable 42 (or along the sensing cable 42) The one or more point sensors 46 may include one or more of a pressure sensor, a temperature sensor, and an acoustic sensor. The one or more point sensors 46 can be interrogated using, including but not limited to, Fiber Bragg Grating (FBG) technology, intensity based sensing and interferometric sensing. The one or more point sensors 46 may be used for measurements of one or more parameters of the well and may also be used for calibration of another sensing system, for example, a distributed sensing system such as DTS, DAS, DSS. In embodiments, a combination of multiple sensing systems may be multiplexed on one optical fiber.

In an embodiment of FIG. 6, a weight 44, which could take the form of cups or other shapes, is affixed to one end of the sensing cable 42 to facilitate deployment. This weight 44 can assist in the cable's descent using gravity and/or fluid propulsion. The weight 44 may be a single rigid mass, a length of flexible chain, or any other design that enables gravity or hydraulic driven forces to aid in the deployment of the sensing cable 42. For example, a weight may be kept in a small pocket at the front of the cable guide 40.

In embodiments, the weight 44 at the end of the sensing cable 42 is not just a simple weight, but a weight assembly that includes one or more of the sensors 46 for real-time well monitoring. One or more pressure sensors, one or more temperature sensors, and also other types of sensors like e.g. hydrophones can be used. These sensors can be either point sensors or distributed sensors, and they can be interrogated either in real-time during deployment or after the deployment has occurred.

In embodiments, subsequently at S360, when the sensing cable is deployed inside the annulus 22, one or more parameters of the well are measured using the sensing cable 42. Signals representative of the parameters are transited along the sensing to computing system 100. The computing system 100 obtains and processes the signals from the sensing cable to determine the parameters.

The processing of signals from the sensing cable provides information to determine the status of the well or to adjust various parameters of the well like pressure, temperature, vibration, and strain.

For example, by analyzing the signals, a fluid flow rate of the well can be determined. This can be used to adjust a pumping rate or production strategy of the well. A pressure within the well can be monitored to optimize the well's production, or detect any anomalies that may require corrective action. Production of the well may be stopped when it is determined that a pressure of the well is greater than a predetermined threshold, for example, a maximum allowable annulus surface pressure (MMASP) of the well. Changes in temperature along the wellbore can be determined from processing of the signals from the sensing cable. Integrity of the well can be monitored as well using DTS and/or DAS.

A leak, a crack or any structural abnormality inside the well can be determined. Based on information obtained from the sensing cable signals, adjustments can then be made, for example, to one or more of a pumping rate, a fracturing operation, or a pressure inside the well to enhance production efficiency and ensure safety. Other parameters of the well may also be measured and other adjustments to the operation of the well may also be made.

The identification of abnormalities within the well significantly depends on the types of measurements taken. For example, temperature deviations from a baseline, such as the geothermal profile, may indicate cross-flow between wells, behind casing or between different producing zones. Acoustic signals can be used to detect leaks or fluid flow due to injection or production. The characteristics of these signals, such as their amplitude, frequency content, and energy within a particular frequency band, can reveal abnormalities like leaks and fluid flows.

In embodiments, operational conditions within the well may be intentionally manipulated to detect potential issues or changes. For example, injecting into or producing fluids from the well can create conditions conducive to leak detection or abnormal flow conditions. These artificially induced scenarios, closely monitored with the sensing systems, enhance the ability to detect and rectify issues promptly.

In embodiments, various sensing principles such as Rayleigh scattering, Brillouin scattering, and Raman scattering may be used for monitoring of the well. For example, Distributed Temperature Sensing (DTS) based on Raman scattering, Distributed Acoustic Sensing (DAS) based on interferometric sensing, and Distributed Strain Sensing (DSS) using interferometric or static strain measurements can be used. In addition, quasi-distributed sensors based on Fiber Bragg Gratings (FBGs) or single point fiber optic sensors can be utilized.

Distributed Temperature Sensing (DTS) systems may use a fiber optic sensing cable deployed inside a wellbore and enable continuous temperature measurements at multiple points. DTS system utilizes the principle of Raman scattering to measure temperature variations. Raman scattering occurs when light is scattered by molecular vibrations in the fiber optic sensing cables. By analyzing characteristics of scattered light, DTS systems can determine temperatures at different locations along the fiber optic sensing cable. Real-time temperature data from DTS systems can be used to assessing the integrity of the well. Temperature fluctuations can indicate presence of leaks. Real-time temperature data can be also used to identify flow imbalances.

Distributed Strain Sensing (DAS) systems, which are based on phase and intensity interferometric sensing, have multiple applications in well monitoring. They can be used to determine fluid flow allocation and detect leaks in real-time by detecting acoustic noise generated by fluid flow. These systems are also sensitive to temperature, mechanical vibrations, and acoustically induced vibrations. The data collected from DAS systems can be transformed from time series data to frequency domain data using techniques like Fast Fourier Transforms (FFT) or wavelet transforms. By analyzing amplitude and frequency variations, events of interest can be identified.

Distributed strain sensing (DSS) systems can be used for monitoring strain changes along a sensing cable is installed in the wellbore. Ae interrogator is used to send light pulses down the sensing cable and measures the backscattered light. A computing system collects data from the interrogator and process the data for monitoring parameters such as wellbore deformation, corrosion and pressure.

Fiber Bragg Grating (FBG) systems uses optical fiber sensors that use the principle of Bragg gratings to measure strain, temperature, and other parameters. When a FBG system can be used together with another sensing system (DAS, DSS or DTS), the FBG system and the other systems may utilize different wavelengths in the same optical sensing fiber to measure different parameters simultaneously by using Wavelength Division Multiplexing (WDM) and/or Time Division Multiplexing (TDM).

Figure 8A:
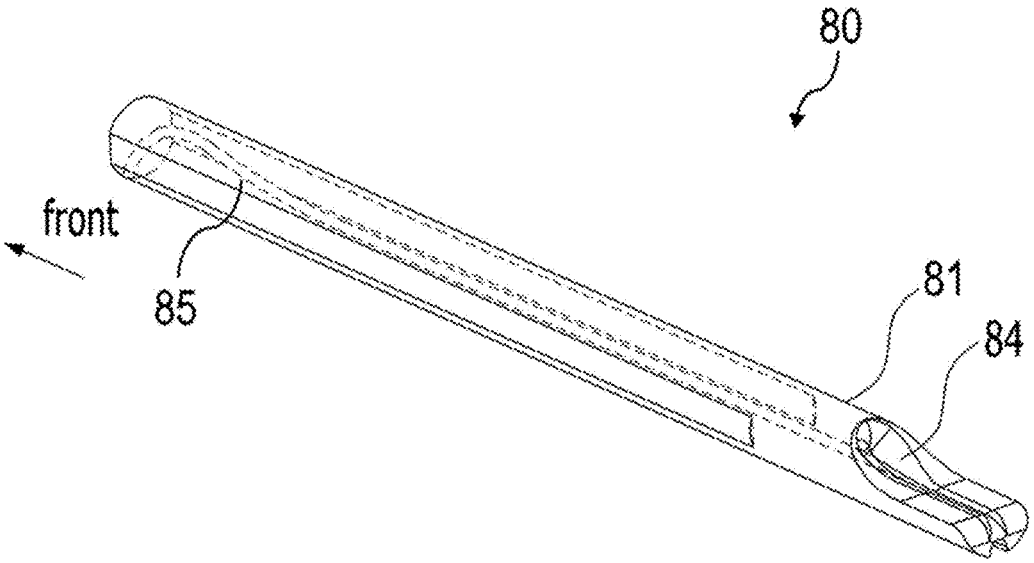
FIGS. 8A-8D illustrate another example cable guide for use in a sensing cable deployment system.
Figure 8B:
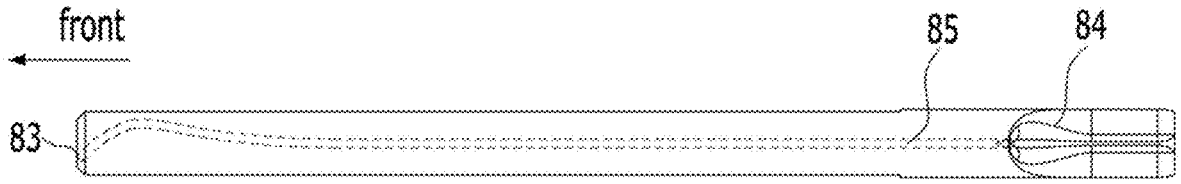
Figure 8C:
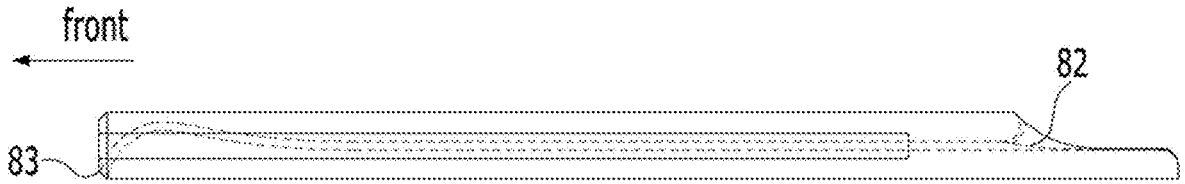
Figure 8D:
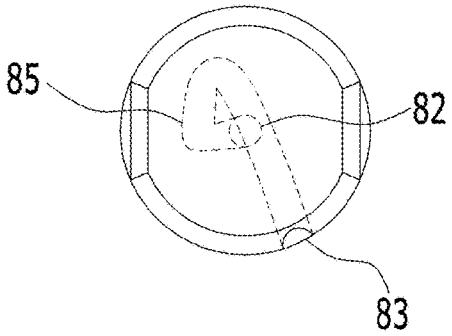

FIGS. 8A-8D show another example cable guide 80 for use in a sensing cable deployment system. FIG. 8A is a perspective view, FIG. 8B is a top view, FIG. 8C is a side view, FIG. 8D is a front view the cable guide 80. The cable guide 80 includes a main body 81, a passage, or cable conduit 85 formed through the main body 81 extending from a cable inlet 82 to a cable outlet 83, a curved surface 84 surrounding the cable inlet 82. A difference from the cable guide of FIGS. 7A-7H is the location of the cable outlet 83. As shown in FIG. 8D, the cable outlet 83 is formed at a perimeter of the main body 81 rather than the body's central portion. While a starting portion of the cable conduit 85 extends straight from the cable inlet 82 similarly to the cable guide 40 of FIGS. 7A-7H, an ending portion of the cable conduit 85 extends further to a perimeter of the main body 81. The cable conduit 85 is sized and configured such that the sensing cable 42 is directed to a deeper portion of the well when being released from the cable outlet 83.

Figure 9:
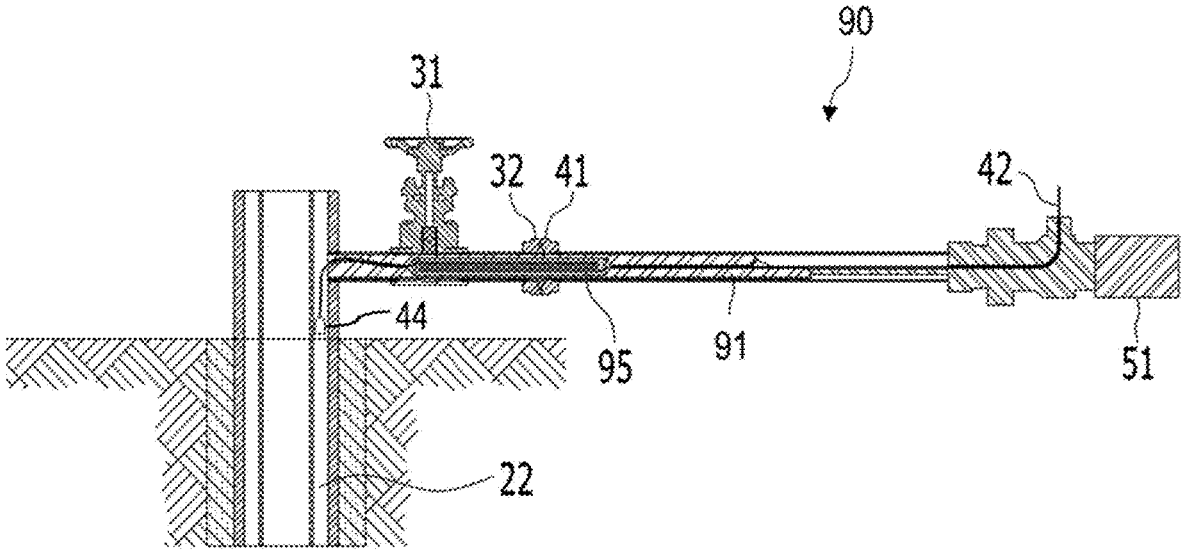
FIG. 9 illustrates another example sensing cable deployment system.

FIG. 9 shows an alternative sensing cable deployment system 90 that uses a bare cable (bare fiber) deployment in which the sensing cable 42 is inserted without the use of the injector pipe 56, the cable injector head 55, or the gooseneck guide 53. In the embodiment of FIG. 9, The cable guide 91 includes a chamber 95 that that serves as a housing for a coil of the sensing cable 42. The chamber 95 is filled with one or more viscous substances such as oil, grease, wax, among others.

The bare cable deployment involves positioning the cable guide 91 through the gate valve 31 until the weight 44 reaches the annulus 22. Then, the weight 44 falls due to gravity drawing the sensing cable 42 downward. As the weight 44 falls, the coil of the sensing cable 42 inside the chamber 95 unwinds.

The one or more viscous substances within the chamber 95 provides resistance and prevents rapid unwinding of the sensing cable such that the sensing cable 42 can be deployed at a predetermined speed. This technique allows a controlled deployment of a pre-coiled sensing cable without the use of the injector pipe 56, the cable injector head 55, or the gooseneck guide 53.

Figure 10:
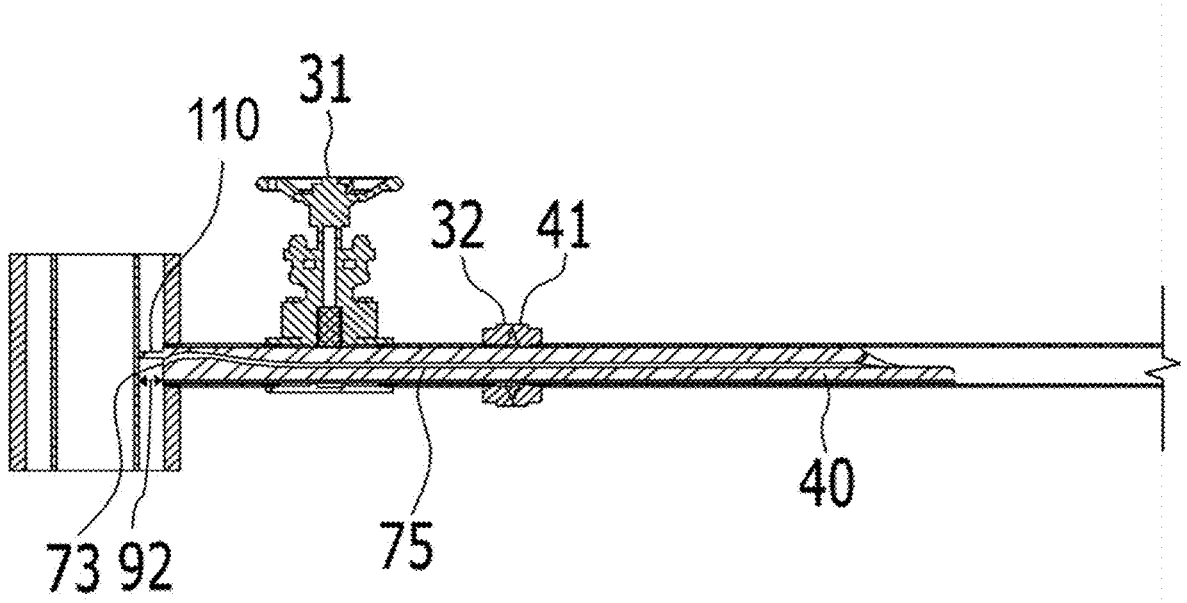
FIG. 10 illustrates an example cable guide having a stand-off extension.

FIG. 10 shows another example cable guide 40 having a stand-off extension 110. The stand-off extension 110 protrudes further than the cable outlet 73 of the cable guide conduit 75 such that the cable outlet 73 is distanced with a gap 92 from the production tubing. The gap 92 is sized so as to position the cable outlet 73 such that the sensing cable 42 falls in the gap 92 and thus the annulus 22 when exiting the cable guide 40. Using the stand-off extension 110 allows the placement of the cable guide 40 at a selected distance from the production tubing without having to track the position of the cable guide 40 as the cable guide 40 is being inserted. Instead, the cable guide 40 is inserted until contact is made between the stand-off extension 110 and an outer surface of the production tubing. Once contact is made, the cable guide 40 is in the proper position for deploying the sensing cable 42 into the annulus 22. In embodiments, a stand-off extension may have a different structure than the example of FIG. 10.

Examples of the above embodiments include:

Example 1 is a method of monitoring a well including a production tubing installed in the well and supported by a wellhead with an annulus between the production tubing and a well casing, the method comprising, while the production tubing remains installed in the well:

opening a valve of the wellhead to provide access to the annulus through a side port of the wellhead;

inserting a cable guide through the valve, wherein the cable guide comprises a conduit for inserting a sensing cable through the cable guide;

inserting a sensing cable through the conduit of the cable guide and into the annulus through the side port;

measuring one or more parameters of the well using the sensing cable and transmitting signals representative of the parameters along the sensing cable; and obtaining and processing the signals from the sensing cable using a computing system to determine the parameters.

In Example 2, the embodiments of any preceding paragraph or combination thereof further include wherein inserting the cable guide further includes inserting the cable guide to a selected position relative to the annulus using a cable guide positioner operable to movably position the cable guide.

In Example 3, the embodiments of any preceding paragraph or combination thereof further include inserting the sensing cable using an injector operable to adjust a length of deployment of the sensing cable into the annulus.

In Example 4, the embodiments of any preceding paragraph or combination thereof further include equalizing pressure between the annulus and a space outside the well while the sensing cable is being inserted through the cable guide using a pressure relief channel in the cable guide separate from the conduit.

In Example 5, the embodiments of any preceding paragraph or combination thereof further include:

inserting the cable guide through the valve until a stand-off extension protruding from the cable guide contacts an outer surface of the production tubing, which places a cable outlet of the conduit at a selected distance from the production tubing; and releasing the sensing cable from the cable outlet and into the annulus.

In Example 6, the embodiments of any preceding paragraph or combination thereof further include wherein inserting the sensing cable through the conduit further comprises inserting the sensing cable through a portion of the conduit oriented in a direction into the well such that the sensing cable is directed to a deeper portion of the well when being released from a cable outlet of the conduit.

In Example 7, the embodiments of any preceding paragraph or combination thereof further include:

wherein the one or more parameters of the well comprise at least one of a pressure, a temperature, a vibration, or a strain of the well; and adjusting operation of the well based on the one or more parameters.

In Example 8, the embodiments of any preceding paragraph or combination thereof further include stopping production of the well when it is determined that a pressure of the well obtained from processing of the signals from the sensing cable is greater than a predetermined threshold.

In Example 9, the embodiments of any preceding paragraph or combination thereof further include wherein the sensing cable comprises one or more of a flexible optical fiber or a fiber-in-metal tube (FIMT).

Example 10 is a system for monitoring a well including a production tubing installed in the well and supported by a wellhead with an annulus between the production tubing and a well casing, the system comprising:

a cable guide comprising a conduit sized to allow insertion of a sensing cable therethrough;

a cable guide positioner operable to movably position the cable guide relative to the wellhead;

an injector operable to insert a sensing cable through the cable guide and into the annulus through a side port of the wellhead; and a computing system connected to the sensing cable and operable to obtain and process signals from the sensing cable to determine one or more parameters relating to the well.

In Example 11, the embodiments of any preceding paragraph or combination thereof further include wherein:

the cable guide comprises an end surface facing the production tubing when the cable guide is inserted through a valve of the wellhead that provides access to the annulus through the side port, the conduit comprises a cable outlet formed at the end surface, the cable outlet configured to introduce the sensing cable into the annulus, and the cable guide further comprises a stand-off extension protruding from the end surface to space the cable outlet a selected distance away from the production tubing when the stand-off extension contacts an outer surface of the production tubing.

In Example 12, the embodiments of any preceding paragraph or combination thereof further include wherein:

the cable guide comprises an end surface facing the production tubing when the cable guide is inserted through a valve of the wellhead that provides access to the annulus through the side port, the conduit comprises a cable outlet formed at the end surface, the cable outlet configured to introduce the sensing cable into the annulus, and the conduit comprises an end portion extending to the cable outlet, the end portion extends along a downward direction such that the sensing cable is heading a deeper portion of the well when being released from the cable outlet.

In Example 13, the embodiments of any preceding paragraph or combination thereof further include wherein:

the cable guide comprises an end the production tubing when the cable guide is inserted through a valve of the wellhead that provides access to the annulus through the side port, and the end portion is sized such that the cable guide is insertable into the side port when the cable guide is inserted through the valve.

In Example 14, the embodiments of any preceding paragraph or combination thereof further include wherein the one or more parameters of the well comprise at least one of a pressure, a temperature, a vibration, or a strain of the well and the computing system is further operable to adjust operation of the well based on the one or more parameters.

In Example 15, the embodiments of any preceding paragraph or combination thereof further include wherein the sensing cable comprises one or more of a flexible optical fiber or a fiber-in-metal tube (FIMT).

Example 16 is a method of installing a sensing cable into a well including a production tubing installed in the well and supported in a wellhead, and an annulus between the production tubing and a well casing, the method comprising, while the production tubing remains installed in the well:

opening a valve of the wellhead to provide access to the annulus;

inserting a cable guide through the valve, wherein the cable guide comprises a conduit for inserting a sensing cable through the cable guide; and inserting a sensing cable through the conduit of the cable guide such that an end portion of the sensing cable travels into the annulus to a selected position.

In Example 17, the embodiments of any preceding paragraph or combination thereof further include wherein the cable guide is inserted to a selected position relative to the annulus using a cable guide positioner operable to movably position the cable guide.

In Example 18, the embodiments of any preceding paragraph or combination thereof further include wherein the sensing cable is inserted though the cable guide and into the annulus using an injector operable to adjust a length of the sensing cable inserted into the annulus.

In Example 19, the embodiments of any preceding paragraph or combination thereof further include equalizing pressure between the annulus and a space outside the well while the sensing cable is being inserted through the cable guide using a pressure relief channel in the cable guide separate from the conduit.

In Example 20, the embodiments of any preceding paragraph or combination thereof further include:

inserting the cable guide through the valve until a standoff extension protruding from the cable guide contacts an outer surface of the production, which places a cable outlet of the conduit at a selected distance from the production tubing; and wherein inserting the sensing cable through the conduit of the cable guide further comprises releasing the sensing cable from the cable outlet and into the annulus.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

Unless specifically stated otherwise as apparent from the foregoing disclosure, it is appreciated that, throughout the present disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about," "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of monitoring a well including a production tubing previously installed in the well and supported by a wellhead with an annulus between the production tubing and a well casing, the method comprising, after the production tubing is and while the production tubing remains installed in the well:

opening a valve of the wellhead to provide access to the annulus through a side port of the wellhead;

inserting a cable guide through the valve, wherein the cable guide comprises a conduit for inserting a sensing cable through the cable guide;

inserting a sensing cable through the conduit and out of the cable guide and into the annulus through the side port;

measuring one or more parameters of the well using the sensing cable and transmitting signals representative of the parameters along the sensing cable; and obtaining and processing the signals from the sensing cable using a computing system to determine the parameters.

2. The method of claim 1, wherein inserting the cable guide further includes inserting the cable guide to a selected position relative to the annulus using a cable guide positioner operable to movably position the cable guide.

3. The method of claim 1, further comprising inserting the sensing cable using an injector operable to adjust a length of deployment of the sensing cable into the annulus.

4. The method of claim 1, further comprising equalizing pressure between the annulus and a space outside the well while the sensing cable is being inserted through the cable guide using a pressure relief channel in the cable guide separate from the conduit.

5. The method of claim 1, further comprising:

inserting the cable guide through the valve until a stand-off extension protruding from the cable guide contacts an outer surface of the production tubing, which places a cable outlet of the conduit at a selected distance from the production tubing; and releasing the sensing cable from the cable outlet and into the annulus.

6. The method of claim 1, wherein inserting the sensing cable through the conduit further comprises inserting the sensing cable through a portion of the conduit oriented in a direction into the well such that the sensing cable is directed to a deeper portion of the well when being released from a cable outlet of the conduit.

7. The method of claim 1, further comprising:

wherein the one or more parameters of the well comprise at least one of a pressure, a temperature, a vibration, or a strain of the well; and adjusting operation of the well based on the one or more parameters.

8. The method of claim 7, further comprising stopping production of the well when it is determined that a pressure of the well obtained from processing of the signals from the sensing cable is greater than a predetermined threshold.

9. The method of claim 1, wherein the sensing cable comprises one or more of a flexible optical fiber or a fiber-in-metal tube (FIMT).

10. A system for monitoring a well including a production tubing installed in the well and supported by a wellhead with an annulus between the production tubing and a well casing and comprising a valve controlling flow through a side port, the system comprising:

a cable guide sized to be insertable through the valve and comprising a conduit sized to allow insertion of a sensing cable therethrough;

a cable guide positioner operable to movably position the cable guide relative to the wellhead;

an injector operable to insert a sensing cable through and out of the cable guide and into the annulus through the side port of the wellhead; and a computing system connected to the sensing cable and operable to obtain and process signals from the sensing cable to determine one or more parameters relating to the well.

11. The system of claim 10, wherein:

the cable guide comprises an end surface facing the production tubing when the cable guide is inserted through the valve of the wellhead that provides access to the annulus through the side port, the conduit comprises a cable outlet formed at the end surface, the cable outlet configured to introduce the sensing cable into the annulus, and the cable guide further comprises a stand-off extension protruding from the end surface to space the cable outlet a selected distance away from the production tubing when the stand-off extension contacts an outer surface of the production tubing.

12. The system of claim 10, wherein:

the cable guide comprises an end surface facing the production tubing when the cable guide is inserted through the valve of the wellhead that provides access to the annulus through the side port, the conduit comprises a cable outlet formed at the end surface, the cable outlet configured to introduce the sensing cable into the annulus, and the conduit comprises an end portion extending to the cable outlet, the end portion extends along a downward direction such that the sensing cable is heading a deeper portion of the well when being released from the cable outlet.

13. The system of claim 10, wherein:

the cable guide comprises an end surface facing the production tubing when the cable guide is inserted through the valve of the wellhead that provides access to the annulus through the side port, and the end portion is sized such that the cable guide is insertable into the side port when the cable guide is inserted through the valve.

14. The system of claim 10, wherein the one or more parameters of the well comprise at least one of a pressure, a temperature, a vibration, or a strain of the well and the computing system is further operable to adjust operation of the well based on the one or more parameters.

15. The system of claim 10, wherein the sensing cable comprises one or more of a flexible optical fiber or a fiber-in-metal tube (FIMT).

* * * * *